US009274492B2

(12) United States Patent
Kouzu

(10) Patent No.: US 9,274,492 B2
(45) Date of Patent: Mar. 1, 2016

(54) CLEANING MECHANISM, TRANSFER BELT, AND IMAGE FORMING APPARATUS COMPRISING THE SAME

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Norio Kouzu, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/574,901

(22) Filed: Dec. 18, 2014

(65) Prior Publication Data

US 2015/0177649 A1 Jun. 25, 2015

(30) Foreign Application Priority Data

Dec. 19, 2013 (JP) ..... 2013-262471

(51) Int. Cl.
*G03G 21/10* (2006.01)

(52) U.S. Cl.
CPC ..... *G03G 21/105* (2013.01); *G03G 21/10* (2013.01); *G03G 2215/0132* (2013.01)

(58) Field of Classification Search
CPC . G03G 15/0889; G03G 21/10; G03G 21/105; G03G 21/12
See application file for complete search history.

(56) References Cited

U.S. PATENT DOCUMENTS

| | | | | |
|---|---|---|---|---|
| 5,812,919 | A * | 9/1998 | Takano et al. | 399/312 |
| 2009/0129810 | A1* | 5/2009 | Kobashi | 399/101 |
| 2010/0143011 | A1* | 6/2010 | Tawada | 399/358 |
| 2010/0189471 | A1* | 7/2010 | Yuge | 399/264 |
| 2011/0091227 | A1* | 4/2011 | Tomita et al. | 399/35 |

FOREIGN PATENT DOCUMENTS

| | | |
|---|---|---|
| JP | 2006-113235 | 4/2006 |
| JP | 2006-330216 | 12/2006 |
| JP | 2007-163956 | 6/2007 |

* cited by examiner

*Primary Examiner* — Rodney Bonnette
(74) *Attorney, Agent, or Firm* — Amin, Turocy & Watson, LLP

(57) ABSTRACT

In accordance with one embodiment, an image forming apparatus comprises a belt to which a toner image formed with toner added with lubricant is transferred; a blade configured to be arranged in a belt width direction of the belt to scrape against the belt surface; a case configured to include room for housing waste toner scraped off by the blade; a conveyance section configured to convey the waste toner towards two end parts in the belt width direction in the room of the case; and an elastic section configured to flick the waste toner conveyed to the two end parts by the conveyance section towards the blade through elastic force.

5 Claims, 12 Drawing Sheets

CLEANING MECHANISM, TRANSFER BELT, AND IMAGE FORMING APPARATUS COMPRISING THE SAME

CROSS-REFERENCE TO RELATED APPLICATION

This application is based upon and claims the benefit of priority from Japanese Patent Application No. 2013-262471, filed Dec. 19, 2013, the entire contents of which are incorporated herein by reference.

FIELD

Embodiments described herein relate generally to an image forming apparatus.

BACKGROUND

A cleaning mechanism which scrapes toner on a transfer belt with a cleaning blade is arranged in an electrophotographic type image forming apparatus. Frictional force occurs between the belt surface and the blade when the transfer belt is rotated, thus, it is necessary to prevent the blade from being curved and curled. Conventionally, there is known an image forming apparatus (see, for example, Japanese Unexamined Patent Application Publication No. 2006-330216) which coats solid lubricant on the belt surface using a coating brush to prevent the blade-curling and a cleaning mechanism (see, for example, Japanese Unexamined Patent Application Publication No. 2007-163956) which scrapes the solid lubricant with a brush roller to coat the lubricant on the cleaned surface. There is also known an image forming apparatus (see, for example, Japanese Unexamined Patent Application Publication No. 2006-113235) which flicks toner serving as the lubricant towards the contact part of the blade and the belt with a brush to supply the toner to the contact part.

DETAILED DESCRIPTION

Figure 1:
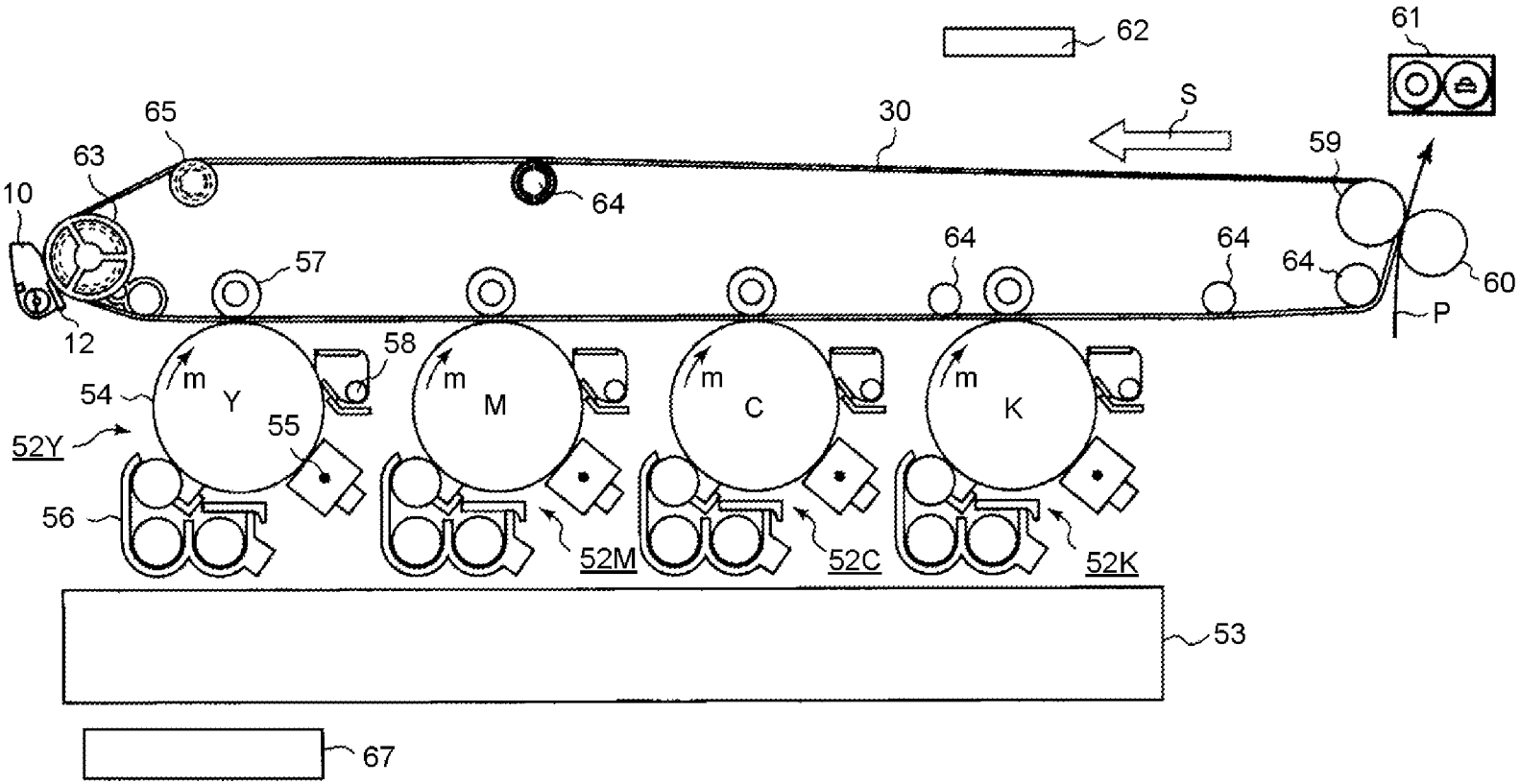
FIG. 1 is a diagram illustrating the constitution of an image forming apparatus according to one embodiment.

In accordance with one embodiment, an image forming apparatus comprises a belt to which a toner image formed with toner added with lubricant is transferred; a blade configured to be arranged in a belt width direction of the belt to scrape against the belt surface; a case configured to include room for housing waste toner scraped off by the blade; a conveyance section configured to convey the waste toner towards two end parts in the belt width direction in the room of the case; and an elastic section configured to flick the waste toner conveyed to the two end parts by the conveyance section towards the blade through elastic force.

Hereinafter, the image forming apparatus according to the embodiment is described with reference to FIG. 1-FIG. 13. Further, the same components are indicated by the same reference numerals in the drawings and repetitive description is not provided.

A First Embodiment

FIG. 1 is a diagram illustrating the constitution of the image forming apparatus according to the embodiment. The image forming apparatus according to the present embodiment is provided with four image forming sections 52Y, 52M, 52C and 52K of four colors, an exposer 53, an endless transfer belt 30 (belt) which is rotated in a direction indicated by an arrow S, and a cleaning mechanism 10 which lubricates the outer peripheral surface of the transfer belt 30 and removes the residual toner left on the outer peripheral surface of the belt. The yellow (Y) image forming section 52Y includes a photoconductive drum 54 which rotates in a direction indicated by an arrow m, a charger 55 which charges the photoconductive drum 54, and a developing device 56 which develops an electrostatic latent image formed on the photoconductive drum 54 by the exposer 53 with toner. The image forming section 52Y further includes a transfer device which primarily transfers a toner image on the photoconductive drum 54 to the outer peripheral surface of the belt, and another cleaning member 58 which cleans the surface of the photoconductive drum 54 after the toner image is transferred to the belt. The magenta (M) image forming section 52M, the cyan (C) image forming section 52C and the black (K) image forming section 52K are structurally identical to the image forming section 52Y. The exposer 53 uses a semiconductor laser or an LED as a light source to form the electrostatic latent image on the photoconductive drum 54. The image forming apparatus is further equipped with a secondary transfer roller pair 59 and 60 which transfers the unfixed toner images of four colors to paper P, a fixing device 61 which fixes the toner image, a controller 62 which controls the image forming processing, a driving roller 63, a plurality of tension rollers 64, and a steering roller 65.

The transfer belt 30 has an endless belt surface to which the toner image formed with the toner added with external additive is transferred and a belt width. The transfer belt 30 includes a belt base material containing, for example, a conductive material and polyimide resin, and a surface layer which covers the belt base material and contains a material for releasing the paper P. The external additive contains components such as silica, zinc stearate, etc.

Figure 2:
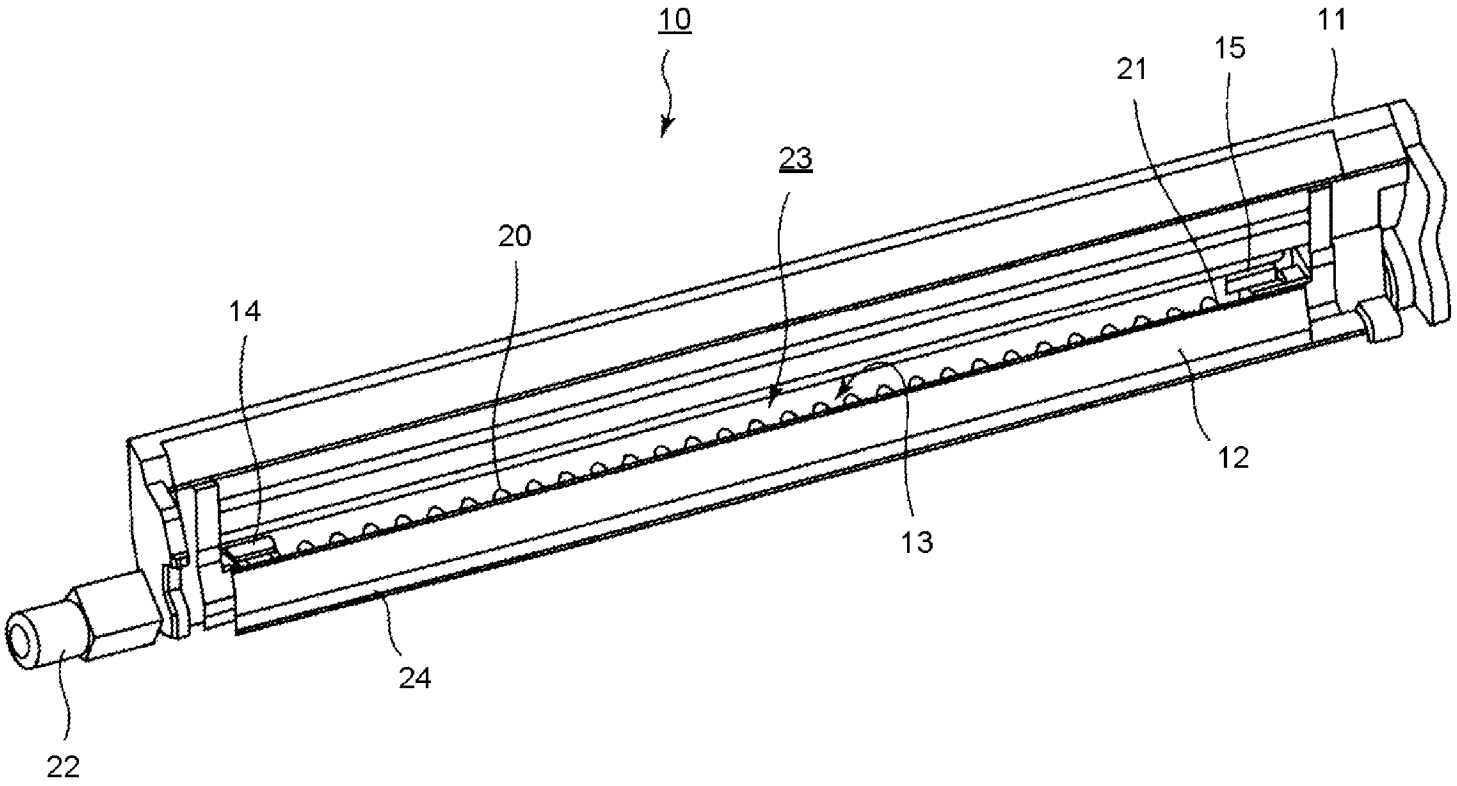
FIG. 2 is a perspective view illustrating a cleaning mechanism including a blade, a case and a conveyance section of the image forming apparatus according to the embodiment.
Figure 3:
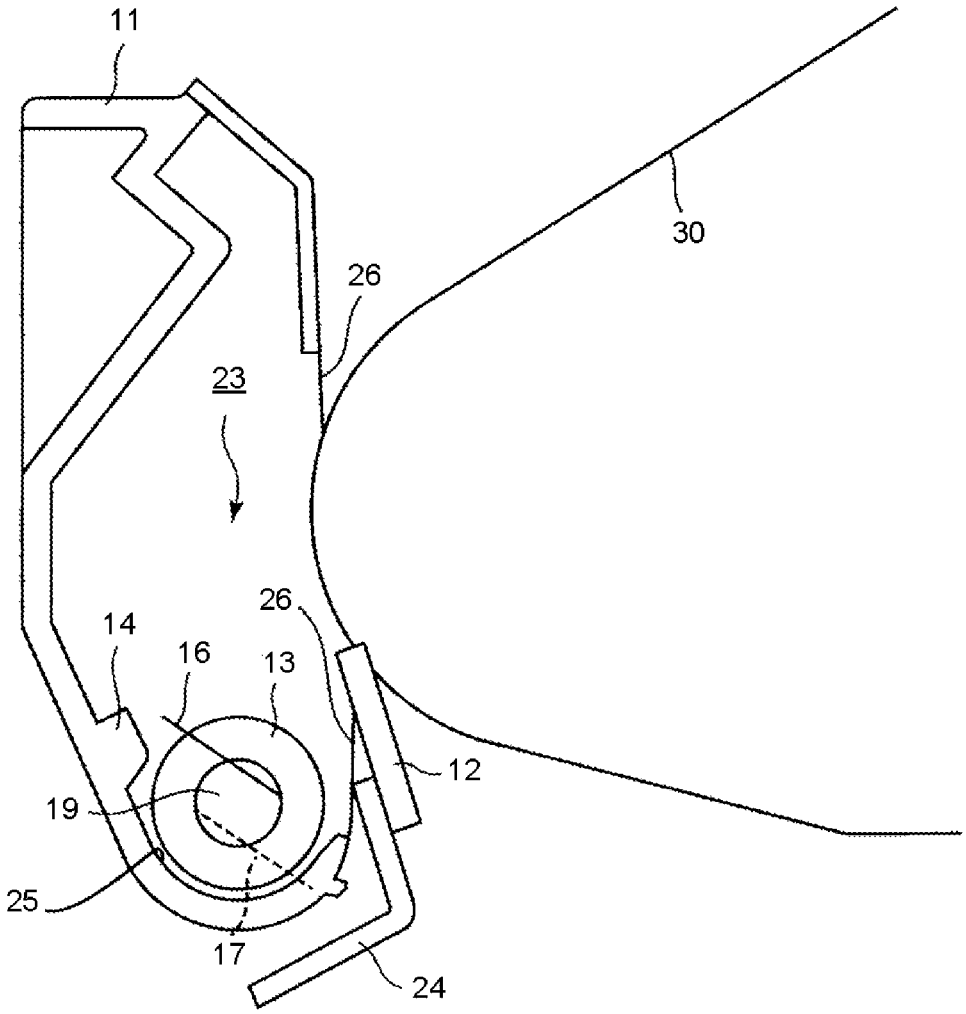
FIG. 3 is a diagram illustrating a longitudinal section of the cleaning mechanism including a blade, a case and a conveyance section of the image forming apparatus according to the embodiment.

FIG. 2 is a perspective view illustrating the cleaning mechanism 10. FIG. 3 is a diagram illustrating a longitudinal section of the cleaning mechanism 10. In FIG. 2 and FIG. 3, the same reference numerals indicate the same components, and the reference numerals mentioned above indicate the same components described above. The cleaning mechanism 10 includes a blade 12 which is arranged parallel to a belt width direction of the transfer belt 30 and scrapes against the belt surface, and a case 11 which has room 23 serving as a space inside the case 11 for housing the waste toner scraped off by the blade 12 and supports the blade 12. The cleaning mechanism 10 further includes an auger 13 (conveyance section) which rotates to convey the waste toner in the room 23 of the case 11 towards two ends in the belt width direction, projection portions 14 and 15 which are arranged inside the room 23 and protrude towards the axis core of the auger 13, two flappers 16 and 17 (elastic sections) (only flapper 16 is shown in FIG. 3) which flick the waste toner conveyed to the two ends by the auger 13 towards the blade 12 through the elastic force thereof, and a motor (not shown) which rotates the auger 13. "Flicking the waste toner" means scattering the waste toner to apply the lubrication component in the toner to the blade 12 and the transfer belt 30.

The blade 12 is an elastic cleaning blade formed by a material such as thermosetting polyurethane rubber and the like. As shown in FIG. 3, the blade 12 is a molded body having a blade thickness, a blade width parallel to the belt width direction and a blade height orthogonal to both the blade thickness direction and the blade width direction; and the blade edges in the blade width direction contacts with the outer peripheral surface of the belt in a counter direction with respect to the rotation direction of the transfer belt 30. A mounting tag is arranged at the lower portion of the back side of the blade 12, and the mounting tag is fixed on a mounting tool 24 in a state of energizing the blade edge to the transfer belt 30. The mounting tool 24 is an L-shaped member (when viewed from lateral side) which is arranged on a frame in the case 11 or the image forming apparatus and has a width the same as the blade width. The case 11 holds the blade 12 horizontally. Two seal members 26 may be arranged at the upper and the lower parts of an opening of the case 11 at the side of the transfer belt 30. The case 11 collects the waste toner scraped off by the blade 12. The case 11 is connected with a waste toner box 67 (FIG. 1) arranged at the outside of the case 11.

Figure 4:
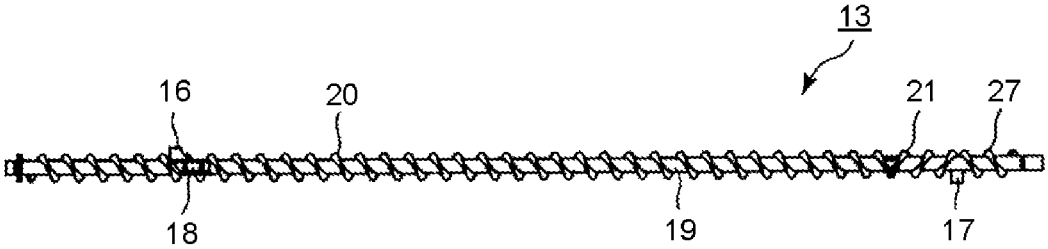
FIG. 4 is a front view illustrating a single body of the conveyance section of the image forming apparatus according to the embodiment.

FIG. 4 is a front view illustrating the single body of the auger 13. In FIG. 4, the reference numerals mentioned above indicate the same components described above. The auger 13 includes an auger shaft 19 pivotally supported parallel to one axis direction parallel to the belt width direction in the room 23, a first vane 20 formed into helixes on the auger shaft 19 and a second vane 21 formed into helixes on the auger shaft 19 in a direction opposite to the winding direction of the first vane 20. The helixes of the first vane 20 has a winding direction in which the waste toner is conveyed towards one end of the blade 12, and the helixes of the second vane 21 has a winding direction in which the waste toner is conveyed towards the other end of the blade 12.

Figure 6:
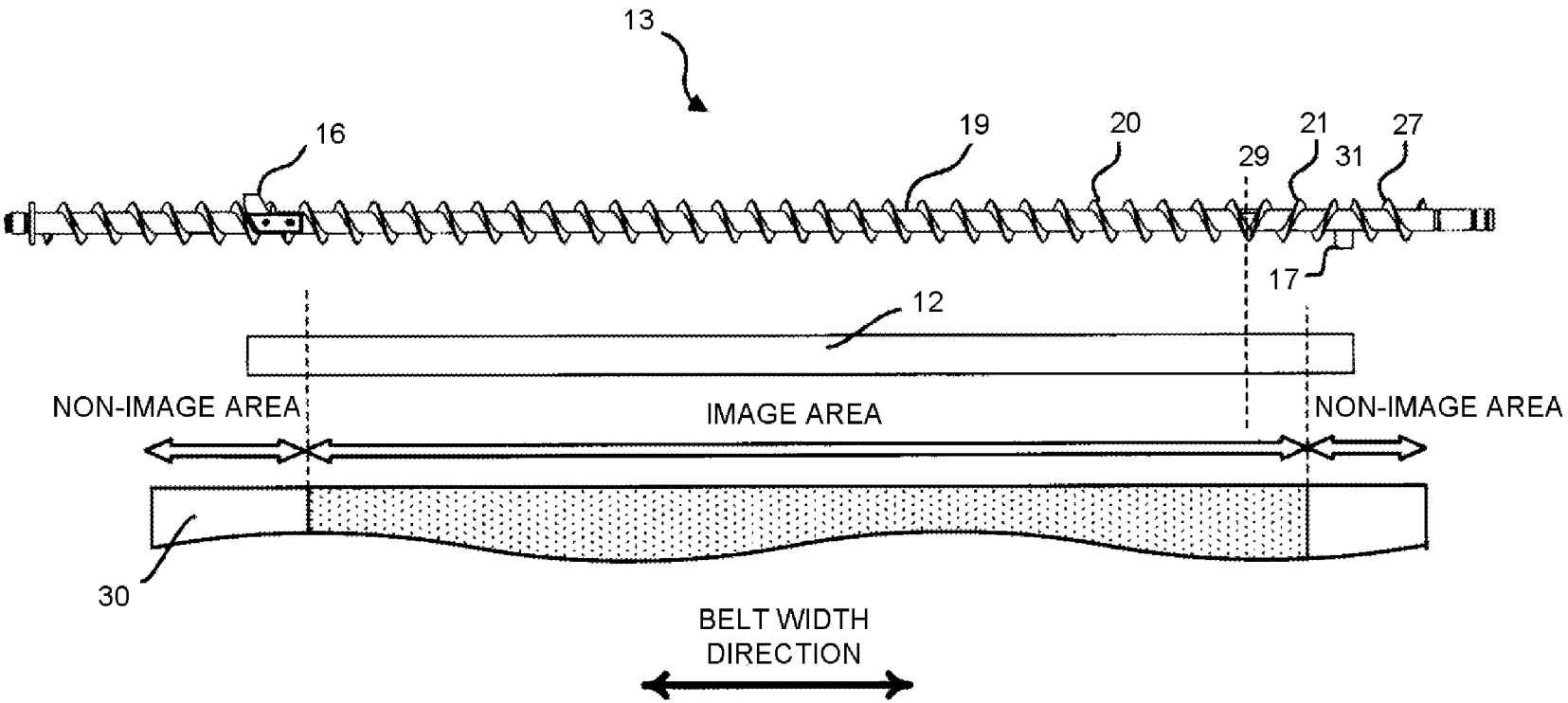
FIG. 6 is a diagram illustrating the position relation between the conveyance section, the blade and a belt of the image forming apparatus according to the embodiment.

FIG. 6 is a diagram illustrating the position relation between the auger 13, the blade 12 and the transfer belt 30 and the relation between the range of the helixes formed by the vane and an image area. The image area is an area where the toner image is formed, and a non-image area refers to an area other than the image area. In FIG. 6, the reference numerals mentioned above indicate the same components described above. An image area and two non-image areas that nip the image area in the belt width direction are formed on the belt surface facing the transfer belt 30. The second vane 21 is arranged between a position 29 where the winding direction changes and a position 31 corresponding to the boundary of the image area and the non-image area on the belt surface. That is, the start position of the helix area of the second vane 21 at one end part (left side in FIG. 6) of the blade 12 is in the image area. The auger 13 further includes a third vane 27 which is arranged next to the second vane 21 at the other end part (right side in FIG. 6) of the blade 12. The third vane 27 is formed into helixes having a winding direction the same as the winding direction of the first vane 20.

Further, when the lengths in the belt width direction in FIG. 6 are compared, the transfer belt 30 and the blade 12 meet the following relation: image area width<blade width of blade 12<belt width. The maximum width of the image area is equal to the image area width of a largest paper that can be printed by the MFP (image forming apparatus).

Figure 5:
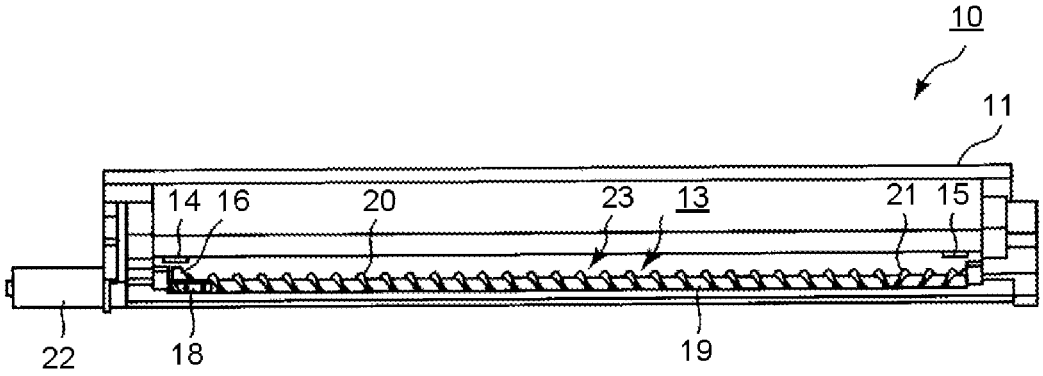
FIG. 5 is a front view illustrating the cleaning mechanism in a state in which the conveyance section of the image forming apparatus according to the embodiment is set.

FIG. 5 is a front view illustrating the cleaning mechanism 10 in a state in which the auger 13 is set and the blade 12 and the seal member 26 are removed. In FIG. 5, the reference numerals mentioned above indicate the same components described above. The projection portions 14 and 15 are arranged at the inner wall of the case 11 at positions facing the outer periphery of the auger 13. The projection portions 14 and 15 are arranged at the two end parts in the axis direction of the auger 13. The projection portion 14 is integrally formed on the housing of the case 11 (FIG. 3) through resin molding on the inner wall part of the case 11. The example of the projection portion 15 is the same as the projection portion 14. An opening is formed on the case 11 in such a manner that the part where the auger 13 is exposed from the case 11 in the left-right direction in FIG. 5 is substantially equal to the range of the image area on the transfer belt 30. When viewed from the front side of the case 11, the mounting height positions of the projection portions 14 and 15 are the same, and the distances from each projection end of the projection portions 14 and 15 to the outer periphery of the auger 13 are the same.

Figure 7:
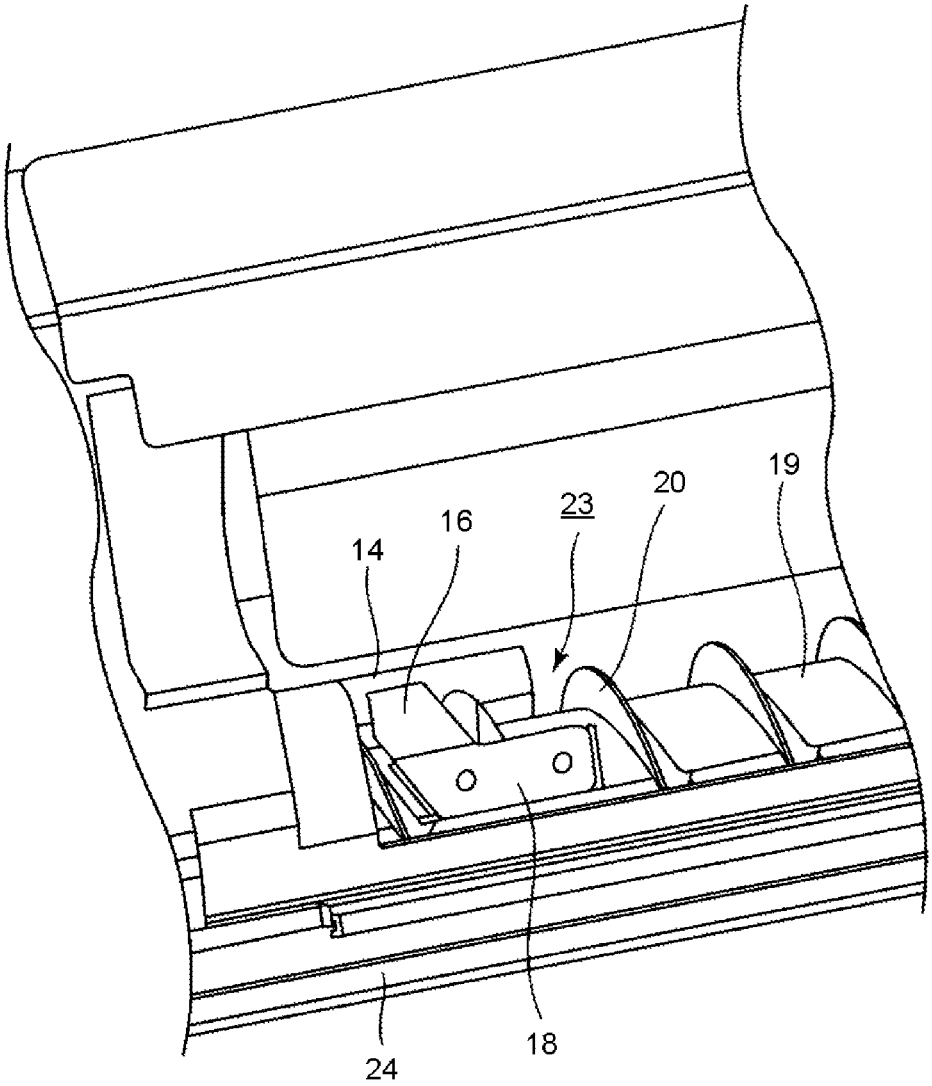
FIG. 7 is a diagram illustrating the main portions of the case in a state in which an elastic section of the image forming apparatus according to the embodiment is mounted.
Figure 8:
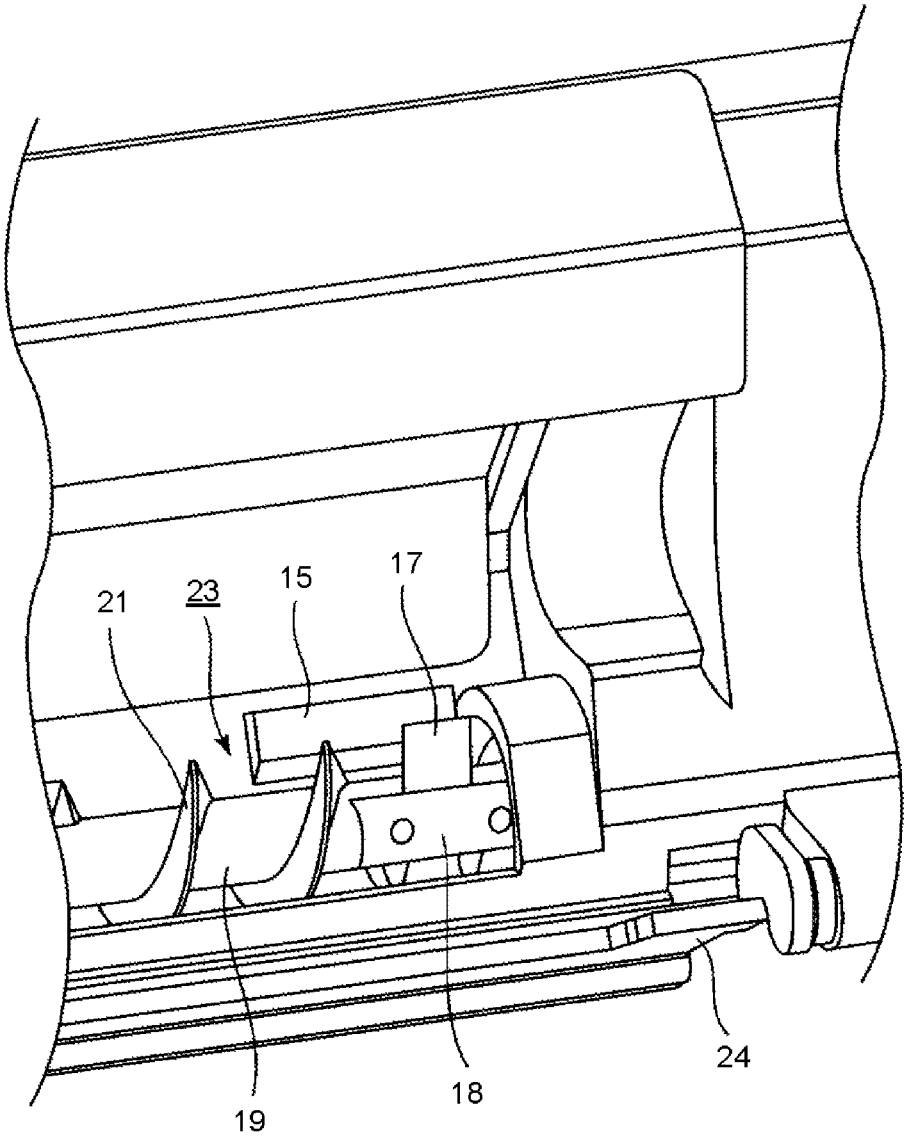
FIG. 8 is a diagram illustrating the main portions of the case in a state in which another elastic section of the image forming apparatus according to the embodiment is mounted.

FIG. 7 is a diagram illustrating the main portions of the case 11 in a state in which the flapper 16 is mounted. FIG. 8 is a diagram illustrating the main portions of the case 11 in a state in which the flapper 17 is mounted. In FIG. 7 and FIG. 8, the reference numerals mentioned above indicate the same components described above. The two flappers 16 and 17 are fixed on the two ends of the auger 13, respectively. Each of the two flappers 16 and 17 circulates between a position where it is flexurally deformed by the projection portions 14 and 15 and a position where it flicks the waste toner towards blade 12 through the force generated when restoring from the flexural deformation. Each of the flappers 16 and 17 is formed into a flat flapper member which includes a root portion fixed at the outer periphery of the auger shaft 19 and a free end standing from the root portion; each root portion of the flappers 16 and 17 is fixed on the auger shaft 19 with a rivet or a screw and a mounting piece 18; and the free ends circulate around the auger shaft 19 through the rotation of the auger shaft 19. An elastic film including thin synthetic resin is used as the flapper 16, and for example, a MYLAR (registered trademark) is used. The flapper 17 is the same as the flapper 16. Further, the mounting position of the flapper 16 on the outer periphery of the auger shaft 19 in the circumferential rotation direction may be shifted from the mounting position of the flapper 17 for a half circumference (refer to FIG. 3 and FIG. 4). That is, in one circle of rotation, the root portions of the flappers 16 and 17 are fixed at positions of which the phases are different from each other for 180 degrees, and the free ends of the flappers 16 and 17 extend outwards from each root portion in the radial direction in a flat shape.

Next, the operation of the image forming apparatus having the foregoing constitution according to the present embodiment is described. In normal operation, the image forming apparatus carries out color printing. In FIG. 1, the controller 62 controls to form electrostatic latent images on four photoconductive drums 54 through charging and exposing operation according to the print data of four print colors. The image forming apparatus develops each electrostatic latent image with the toner of four colors. The image forming apparatus transfers the toner images of four colors generated through the developing operation to the transfer belt 30 in sequence. The image forming apparatus fixes the color toner image secondarily transferred to the paper P and prints and outputs the paper P. In the cleaning mechanism 10, the blade 12 scrapes the residual toner of four colors adhered to the image area on the transfer belt 30 and the paper dust adhered to the transfer belt 30, and the residual toner and the like scraped off by the blade 12 are collected in the room 23.

Figure 9:
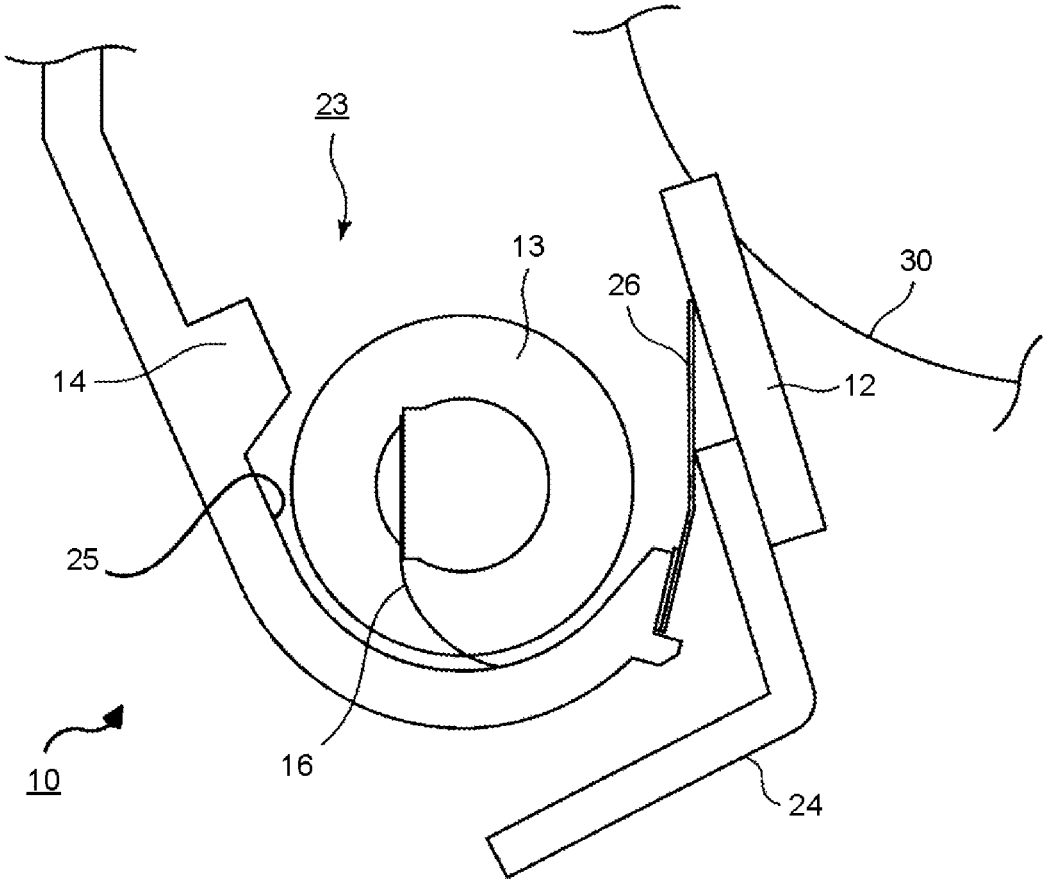
FIG. 9 is a diagram illustrating a first circulating position of the elastic section of the image forming apparatus according to the embodiment.

FIG. 9 is a diagram illustrating a first circulating position of the flapper 16. In FIG. 9, the cleaning mechanism 10 is viewed from the front side of the machine. The controller 62 controls to drive the transfer belt 30 to rotate, and drive the auger 13 to rotate clockwise by a motor for driving the auger 13. The root portion of the flapper 16 is fixed on the auger 13 and the free end abuts against an inner wall surface 25 of the room 23 of the case 11, and the flapper 16 is flexurally deformed with the edge of the free end left behind in an anticlockwise direction. The toner scraped off by the blade 12 falls to the bottom of the room 23 due to the seal member 26. The example of the flapper 17 is the same as the flapper 16.

In a front view of the blade 12 in the longitudinal direction, in the helix area of the first vane 20 shown in FIG. 4-FIG. 6, the toner collected to the bottom of the room 23 or the inner wall surface 25 is conveyed towards the left side, that is, one end part of the blade 12 by interlocking with the clockwise rotation of the auger 13. As shown by the main portions in FIG. 7, the toner starts to move towards one end of the blade 12. On the other hand, in the helix area of the second vane 21, the auger 13 conveys the toner towards the right side, that is, the other end part of the blade 12 by interlocking with the rotation thereof; and in the helix area of the third vane 27, the toner is conveyed towards the opposite end part of the blade 12. In this way, the toner starts to gather towards the flapper 17 from the left and the right sides.

Figure 10:
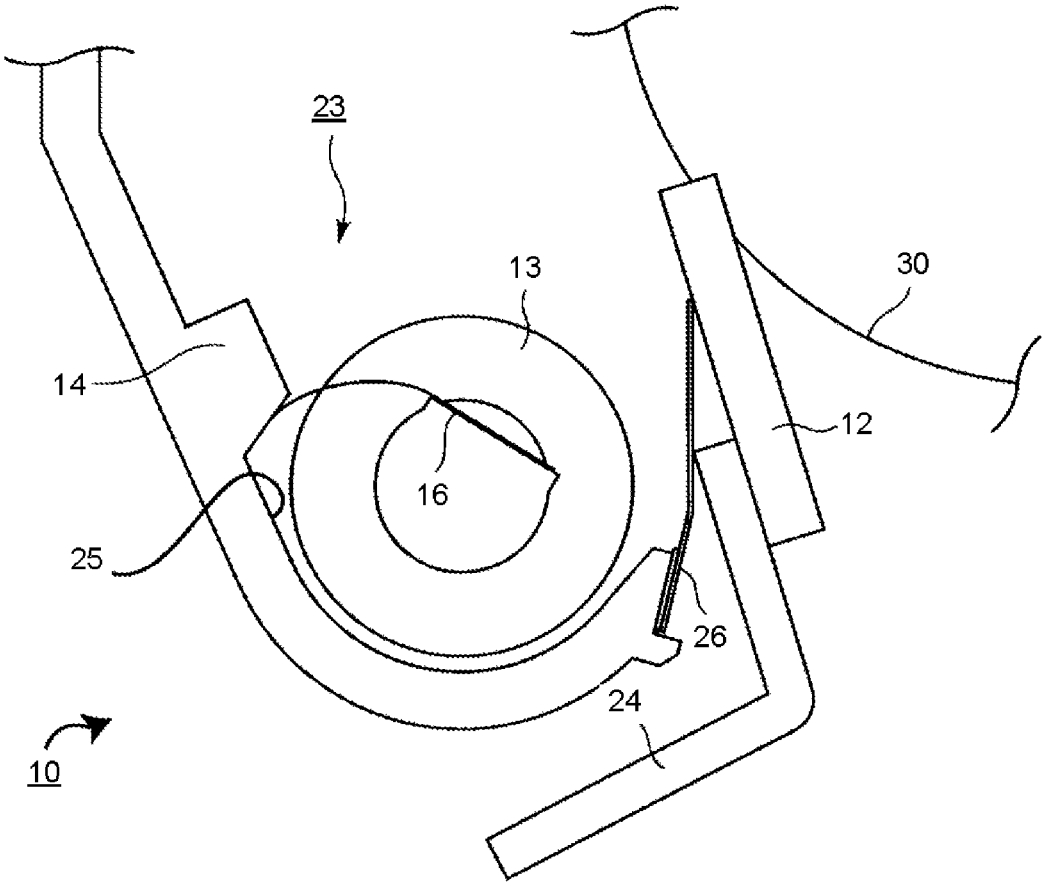
FIG. 10 is a diagram illustrating a second circulating position of the elastic section of the image forming apparatus according to the embodiment.

FIG. 10 is a diagram illustrating a second circulating position of the flapper 16. If the auger 13 is further rotated, the flapper 16 is rotated in a state in which the free end thereof abuts against the inner wall surface 25 by interlocking with the rotation of the auger 13, and then flexurally deformed along the outer shape of the projection portion 14. In the front view of the blade 12, the toner is conveyed towards the left side by the first vane 20, and the toner is conveyed towards the flapper 17 from the left and the right sides by the second vane 21.

Figure 11:
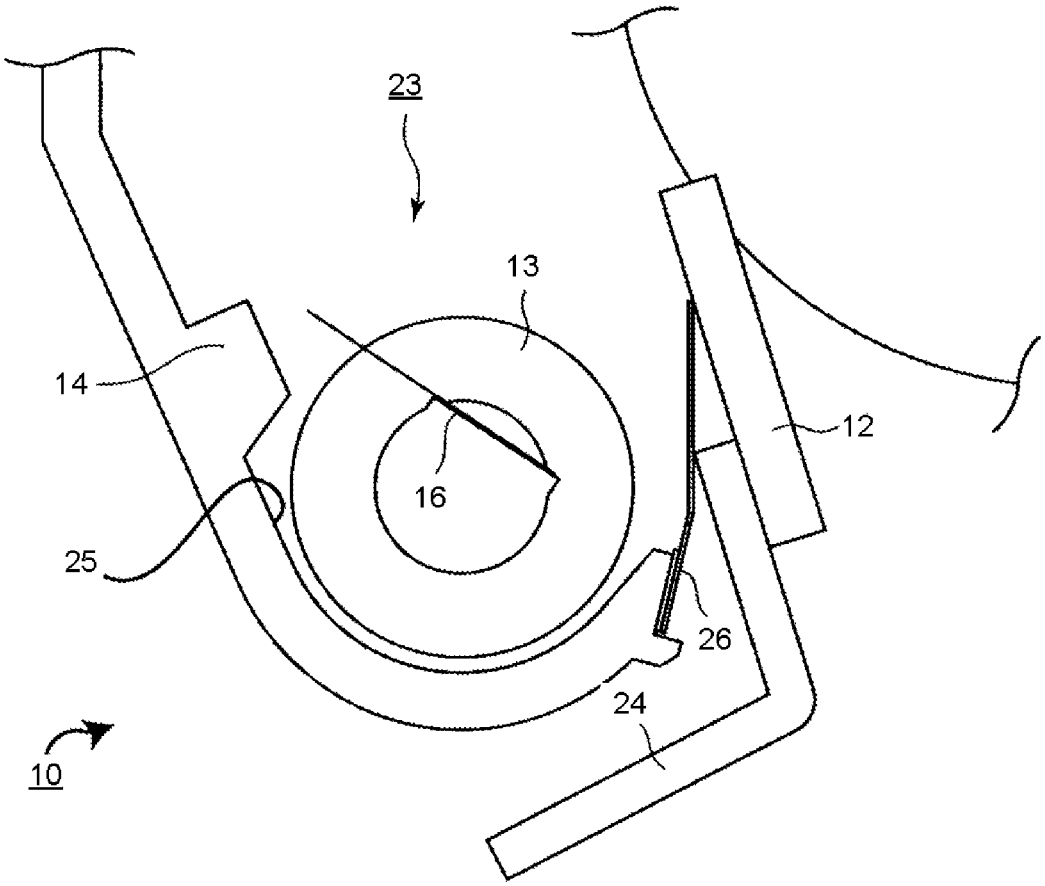
FIG. 11 is a diagram illustrating a third circulating position of the elastic section of the image forming apparatus according to the embodiment.

FIG. 11 is a diagram illustrating a third circulating position of the flapper 16. If the auger 13 is further rotated, the free end of the flapper 16 separates from the projection portion 14 and the flapper 16 releases the energy generated from the elastic repulsive force accumulated in the flexural deformation as a restoring force at once. The toner scraped off from the inner wall surface 25 by the free end of the flapper 16 and adhered to the flapper 16 and the toner conveyed to the flapper 16 by the first vane 20 are flicked and then adhered to the contact part of the blade 12 and the transfer belt 30. The contact part is lubricated by the lubricant contained in the toner. Further, the example of the flapper 17 arranged at the other end of the blade 12 is the same as the flapper 16.

Figure 12:
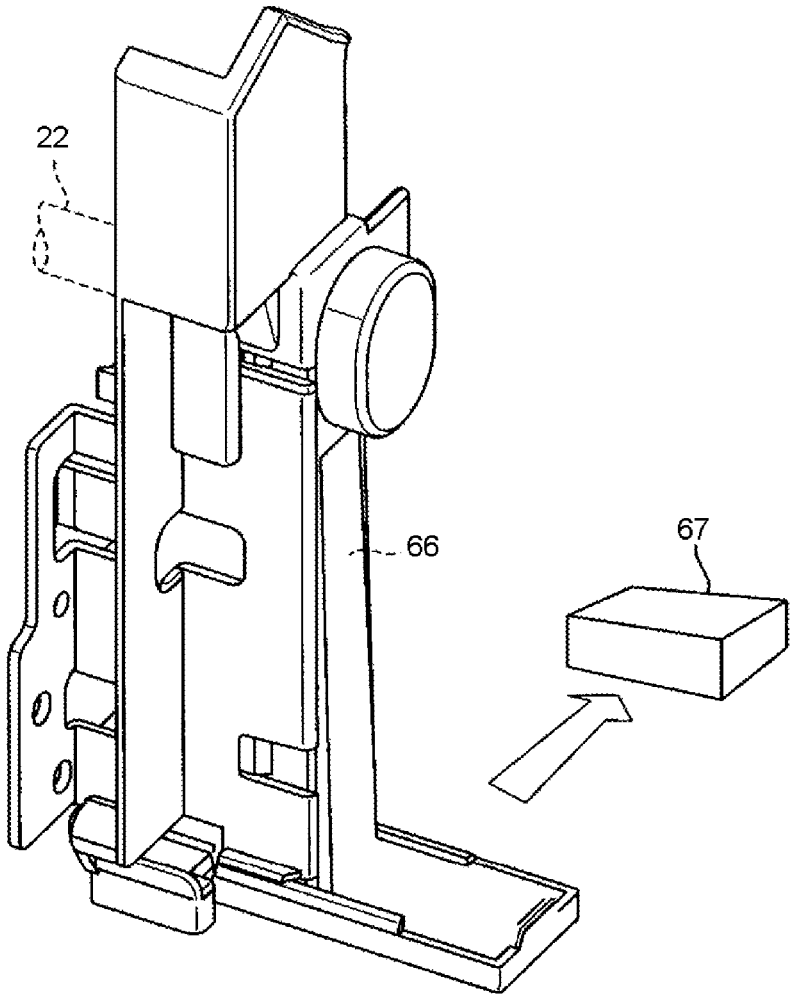
FIG. 12 is a diagram illustrating an example of a waste toner discharge path arranged in the image forming apparatus according to the embodiment.

FIG. 12 is a diagram illustrating an example of a discharge path of the waste toner. In FIG. 12, the reference numerals mentioned above indicate the same components described above. The cleaning mechanism 10 conveys the collected waste toner to, for example, the front side by the auger 13. A case end part 22 is a cylindrical part that forms an opening in the room 23, and the cleaning mechanism 10 discharges the waste toner from the room 23 to the waste toner box 67 through a duct 66.

To summarize the above, the cleaning mechanism 10 of the transfer belt 30 serving as a toner image carrier is equipped with an auger mechanism for conveying the waste toner that is left after the transfer and is scraped off by the blade 12. The elastic flappers 16 and 17 are arranged at positions facing or nearby the two end parts of the blade of the auger 13. The flappers 16 and 17 rotate together with the auger 13 and contact with the projection portions 14 and 15 arranged at the fixed member around the auger 13 in the rotation process. When the flappers 16 and 17 contacting with the projection portions 14 and 15 pass through the projection portions, the waste toner adhered to the flappers 16 and 17 is flicked through the elastic force. The flicked waste toner adheres to the transfer belt 30 and the lubrication component of the toner adheres to the transfer belt 30. With such a constitution, the image area and the non-image area other than the image area of the transfer belt 30 can be lubricated even if the solid lubricant is not used. In accordance with the image forming apparatus according to the present embodiment, the belt surface can be lubricated without increasing the number of the components of the cleaning mechanism 10 and arranging other components separately from the cleaning mechanism 10. The lubricating action can be achieved without complicating the constitution of the cleaning mechanism 10 and changing the size of the space taken in the image forming apparatus. Further, the blade-curling can be prevented.

Prior to the use of the image forming apparatus by a user, for example, at the time of factory shipment after the assembling processing, kynar (registered trademark) powder is dusted onto the transfer belt 30 and the transfer belt 30 is rotated for a number of circles. In the example shown in FIG. 1, the blade 12 contacts with the transfer belt 30 in the counter direction. If no action is taken to lubricate the belt surface and the blade edge before normal operation, the blade 12 is curved and curled in the belt rotation direction when the rotation of the transfer belt 30 is started.

The blade 12 is curled because the frictional force between the front end part of the blade 12 (that is, the blade edge long side portion) and the image carrier (transfer belt 30) serving as a slide member is increased in the operation. Inmost cases, such a phenomenon occurs significantly at the two end parts of the blade 12 in the longitudinal direction.

The lubricant containing the components such as silica and zinc stearate is added to the toner to prolong the service life of the photoconductive drum 54, and the area of the belt surface where the toner is adhered is lubricated by the lubricant. However, the two end parts of the blade 12 outside the image area are not lubricated by the toner, thus, the frictional force between the blade 12 and the transfer belt 30 is increased, which may lead to the curling of the blade 12.

In the image forming apparatus according to the present embodiment, the waste toner scraped off from the transfer belt 30 by the blade 12 after the transfer of the toner image is flicked and adhered to belt surface of the transfer belt 30 nearby the two end parts of the blade 12, in this way, the belt surface is lubricated by the additive of the toner, which can prevent blade from being curled without changing the constitution and the number of the components of the cleaning mechanism 10.

Modification

The helix shape vane part of the auger 13 may be changed.

Figure 13:
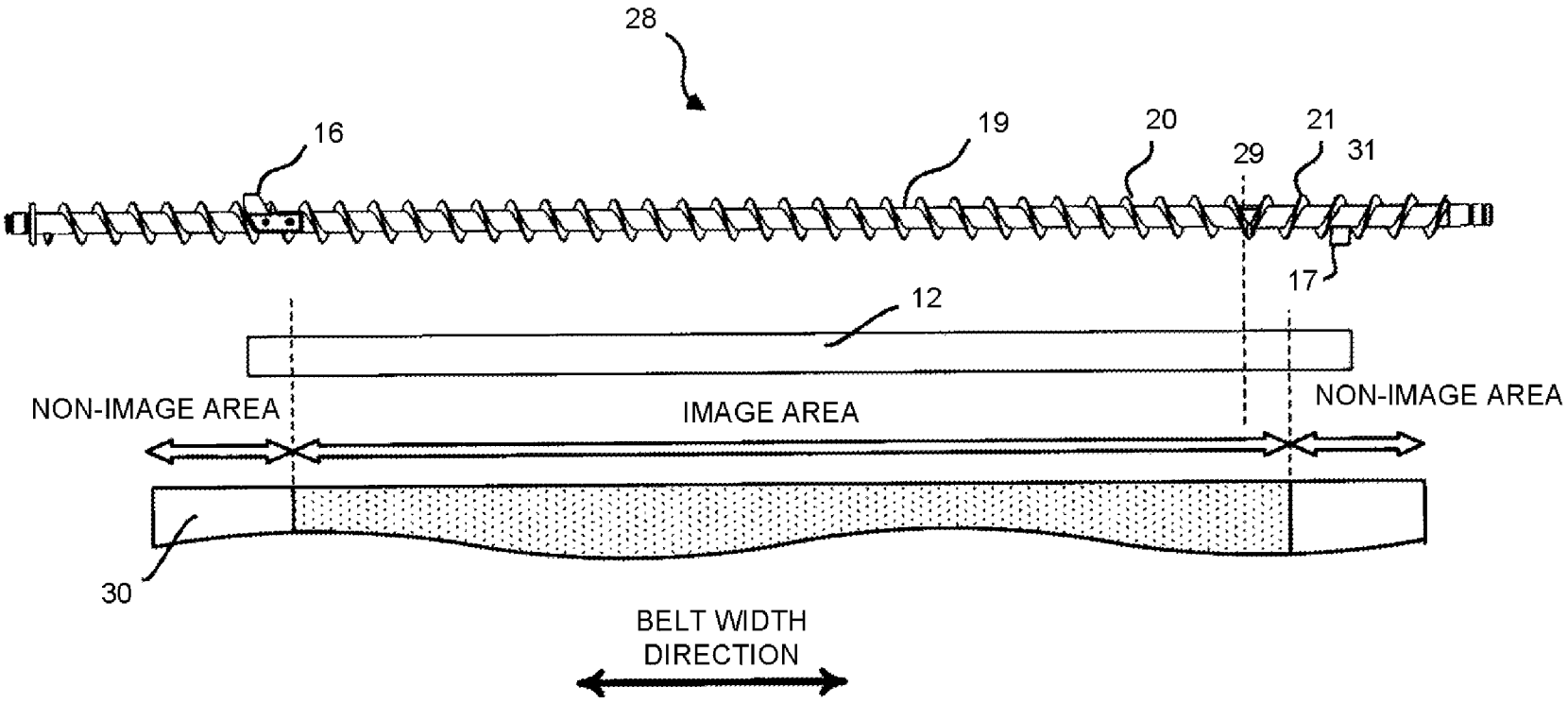
FIG. 13 is a diagram illustrating the position relation between another auger, the blade and the belt of a modification of the embodiment.

FIG. 13 is a diagram illustrating the position relation between another auger, the blade 12 and the transfer belt 30. In FIG. 13, the reference numerals mentioned above indicate the same components described above. The another auger 28 includes the first vane 20 and the second vane 21, and the position 29 where the helixes of the second vane 21 at one end part (left side in FIG. 13) of the blade 12 start is corresponding to the image area. The other parts of the auger 28 are structurally identical to the auger 13. There is no third vane formed in the auger 28, and the range of the helixes of the second vane 21 extends astride the image area and the non-image area on the transfer belt 30 to the other end (right side in FIG. 13) of the blade 12. A discharge path towards the waste toner box 67 is arranged at the right tip of the helix range of the second vane 21.

Next, the operation of the image forming apparatus according to the modification is described. Similar to the example shown in FIG. 9, when the auger 28 is driven to rotate in a clockwise direction viewed from the front side, the flapper 16 is flexurally deformed, and the toner scraped off by the blade 12 falls to the bottom of the room 23 in the case 11. In the front viewed of the blade 12, as shown in FIG. 13, in the helix area of the first vane 20, the auger 28 conveys the toner stacked at the bottom of the room 23 or the toner on the inner wall surface 25 towards one end part (left side) of the blade 12; and in the helix area of the second vane 21, the auger 28 conveys the toner stacked at the bottom of the room 23 or the toner on the inner wall surface 25 towards the other end part (right side) of the blade 12. The toner is conveyed towards the two ends of the blade 12 in the longitudinal direction.

Similar to the examples shown in FIG. 10 and FIG. 11, if the auger 28 is further rotated, the flapper 16 is rotated in a state in which the free end of the auger 28 abuts against the inner wall surface 25. When the free end separates from the projection portion 14, the flexural deformation restores, and the toner scraped off from the inner wall surface 25 by the free end and adhered to the flapper 16 and the toner conveyed to the flapper 16 by the first vane 20 are flicked and then adhered to the contact part of the blade 12 and the transfer belt 30. The contact part is lubricated by the lubricant contained in the toner. Further, the example of the flapper 17 arranged at the other end of the blade 12 is the same as the flapper 16.

The inclination and the helical pitch of the vane of the auger 13 in the embodiment described above can be changed freely. It is exemplified in the embodiment that one auger 13 is arranged to convey the toner towards the two ends of the blade 12, however, the present invention is not limited to this. For example, two auger members different in the winding direction of the helixes may be arranged parallel to each other in the case 11. In this case, the flapper members are arranged on each of the auger members, and the projection members may be formed properly in the case 11, in this way, an effect which is almost the same as the effect achieved by one auger 13 can be achieved.

It is exemplified in the embodiment described above that the projection portions 14 and 15 are formed in the housing of the case 11 through molding processing, however, it is also applicable to create two projection members having the same projection shape as the projection portions 14 and 15 as single bodies in advance, and then attach, weld or adhere the single bodies of the projection members to the inner wall of the case 11 to function as the projection portions 14 and 15.

The flappers 16 and 17 are described as the elastic sections; however, the shape, the size and the mounting positions of the elastic sections and the method for fixing the elastic sections on the auger 13 can be changed freely. Further, no specific limitation is given to the material of the flappers 16 and 17 as long as the material can be flexurally deformed and can restore from the flexural deformation. The projection portions 14 and 15 may be, for example, mountain-shaped, rib-shaped or stepped projection portions. The size of the projection portions 14 and 15, the mounting range on the inner wall of the case 11 and the projection height in the protruding direction can be changed freely, or changed according to the shape of the flappers 16 and 17. It goes without saying that the modification can be carried out on condition that the projection portions 14 and 15 do not interfere with the rotation of the auger 13 equipped with the flappers 16 and 17, the flexural deformation, restoring, and the waste toner flicking operation of the flappers 16 and 17. It is exemplified in the embodiment described above that the projection portions 14 and 15 are arranged at each end; however, the same effect can be achieved by arranging one projection portion having a length along the longitudinal direction of the case 11 at the inner wall of the case 11.

Further, it is also applicable to arrange the projection portions 14 and 15 at the outer periphery of the auger shaft 19; arrange the flappers 16 and 17 at a gap from the inner wall surface; and arrange a spring, which contracts when contacted with the circulating flappers 16 and 17 and extends when the flappers 16 and 17 pass through, between the flappers 16 and 17 and the inner wall surface 25, to scatter the waste toner.

Moreover, the ranges of the image area and the non-image area, and the position where the winding direction of the helixes changes shown in FIG. 6 may be changed freely. The superiority of the image forming apparatus according to the embodiment is not compromised even in a case of an implementation in which these changes are made.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An image forming apparatus comprising:

a belt to which a toner image formed with toner added with lubricant is transferred;

a blade configured to be arranged in a belt width direction of the belt to scrape against the belt surface;

a case configured to include room for housing waste toner scraped off by the blade;

a conveyance section configured to convey the waste toner towards two end parts in the belt width direction in the room of the case;

an elastic section configured to flick the waste toner conveyed to the two end parts by the conveyance section towards the blade through elastic force; and more than one projection portion configured to be arranged in the room to protrude towards the conveyance section; wherein the elastic section is a flapper member which includes a root portion fixed at the outer periphery of the conveyance section and a free end standing from the root portion, and at the two ends of the conveyance section are arranged a plurality of flapper members which circulate around the conveyance section between a position where each free end thereof is flexurally deformed by the projection portions and a position where the flapper members flick the waste toner towards blade through the force generated when restoring from the flexural deformation.

2. The image forming apparatus according to claim 1, wherein the elastic section flicks the waste toner towards areas of the belt surface which contact with the end parts of the blade.

3. The image forming apparatus according to claim 2, wherein the blade width of the blade is wider than the width of an image area formed on the belt surface and narrower than the belt width.

4. The image forming apparatus according to claim 1, wherein the blade width of the blade is wider than the width of an image area formed on the belt surface and narrower than the belt width.

5. The image forming apparatus according to claim 1, wherein the conveyance section includes an auger shaft which is pivotally supported parallel to the belt width direction in the room, a first vane formed into helixes on the auger shaft in a winding direction for conveying the waste toner towards one end of the blade, and a second vane formed into helixes on the auger shaft in a winding direction opposite to the winding direction of the first vane to convey the waste toner towards the other end of the blade.

* * * * *